US005824187A

United States Patent [19]

Richter et al.

[11] Patent Number: 5,824,187

[45] Date of Patent: Oct. 20, 1998

[54] METHOD FOR THE CONTINUOUS COOKING OF PULP

[75] Inventors: Johan Richter, Oslo, Norway; Ole Richter, Karlstad, Sweden

[73] Assignee: Kvaerner Pulping AB, Sweden

[21] Appl. No.: 801,524

[22] Filed: Feb. 18, 1997

Related U.S. Application Data

[63] Continuation-in-part of Ser. No. 663,213, Jun. 12, 1996, Pat. No. 5,716,497.

[30] Foreign Application Priority Data

Dec. 29, 1993 [SE] Sweden ..... 9304333

[51] Int. Cl.[6] ..... D21C 7/00

[52] U.S. Cl. ..... 162/41; 162/17; 162/19; 162/29

[58] Field of Search ..... 162/19, 29, 41, 162/237, 242, 249, 251, 17, 30.1, 33, 34, 263

[56] References Cited

U.S. PATENT DOCUMENTS

| | | | |
|---|---|---|---|
| 4,123,318 | 10/1978 | Sherman | 162/19 |
| 5,053,108 | 10/1991 | Richter | 162/237 |
| 5,080,755 | 1/1992 | Backlund | 162/19 |
| 5,089,086 | 2/1992 | Silander | 162/19 |
| 5,192,396 | 3/1993 | Backlund | 162/19 |
| 5,346,591 | 9/1994 | Henricson | 162/249 |

FOREIGN PATENT DOCUMENTS

| | | |
|---|---|---|
| 0477059 | 3/1992 | European Pat. Off. . |
| 8804578 | 10/1992 | Sweden . |
| WO 91/05103 | 4/1991 | WIPO . |

*Primary Examiner*—Peter Chin
*Assistant Examiner*—Steven B. Leavitt
*Attorney, Agent, or Firm*—Fasth Law Office; Rolf Fasth

[57] ABSTRACT

The present invention relates to a method for continuously producing pulp in which finely divided fiber material, preferably wood chips, is impregnated in an impregnation vessel (10), preferably by being fed in at the top (14) and fed out from the bottom (16) of the said vessel (10), in which cooking pressure essentially prevails in the said first vessel (10). The impregnation vessel, preferably, does not have a screen. The chips are heated and impregnated with the aid of black liquor that is concurrently flowing with a flow of the wood chips which have been thoroughly impregnated with boiling hot black liquor are transferred to the top (28) of a steam-phase digester (12). The pulp is permitted to flow passed at least one screen girdle (32) for drawing off spent liquor. The drawn off spent liquor has a high amount of effective alkali. The upper portion of the digester (12) has an effective alkaline level that is higher than the effective alkali level at the lower portion of the digester but the temperature in the lower portion of the digester is higher than the temperature in the upper portion thereof.

27 Claims, 1 Drawing Sheet

METHOD FOR THE CONTINUOUS COOKING OF PULP

PRIOR APPLICATION

This is a continuation-in-part application of U.S. patent application Ser. No. 08/663,213 filed on 12 Jun., 1996, now U.S. Pat. No. 5,716,497.

TECHNICAL FIELD

This invention relates to a new method and device for producing pulp, mainly sulphate cellulose, by using a continuous cooking process. The method and the device are based on impregnating the chips in a screen-free impregnation vessel by using hot black liquor that is introduced in a flow that is concurrent with the flow of the chips.

BACKGROUND AND SUMMARY OF THE INVENTION

Experiments on black liquor impregnation are already in progress in connection with the production of sulphate cellulose pulp in continuous cooking. These experiments are demonstrating propounded theories, i.e. that impregnation with the aid of black liquor improves the strength properties of the fibers in the pulp produced in this manner. It appears that the principal reason for the improvement in the strength properties of the fibers is the fiber-sparing effect of the black liquor in combination with the relatively late introduction of a rather large quantity of white liquor, as described in all essentials in our own application EP 91402350.

If, as is customary, a large proportion of white liquor is used in connection with the impregnation, this results in certain fibers being exposed to the aggressive effect of the white liquor, with carbohydrates being broken down in the fiber and the strength of the fiber is therefore reduced. The aim of the impregnation is, in the first place, to thoroughly soak each chip so that it becomes susceptible, by diffusion, to the active cooking chemicals which, in the context of sulphate cellulose, principally consist of sodium hydroxide and sodium sulphide. Following diffusion, the active cooking chemicals dissolve the lignin (which binds the fibers together) so that a finished cooked pulp can be obtained.

However, certain types of lignin are more readily dissolved than are others. These readily dissolved lignin can be dissolved both by sodium sulphide and by sodium hydroxide. However, other types of lignin, which are more difficult to dissolve, require sodium hydroxide as the dissolving agent. The disadvantage of sodium hydroxide is that, as has already been described, it also attacks carbohydrates (as early as in the heating-up span at 120°–140° C.) resulting in the strength of the fibers being decreased. The sodium sulphide, on the other hand, mainly attacks the lignin rather than the carbohydrates (at cooking temperature, i.e. greater than about 150° C.), and does not, therefore, have the same fiber-weakening effect.

It has long been known that the spent liquor withdrawn from a sulphate cellulose cook, i.e. black liquor, contains a very small residual quantity of sodium hydroxide but a relatively large proportion of sulphide.

By using black liquor as an impregnation liquid, the advantage is thus achieved that certain types of readily soluble lignin are dissolved at the same time as the fiber strength is essentially preserved. The black liquor may be introduced in a flow that is concurrent with the flow of the chips that are conveyed through the impregnation vessel. Over and above this, important gains can be made purely from the point of view of heat economy by directly utilizing the heat in the hot drawn-off black liquor by supplying it for impregnation essentially without any cooling. An additional advantage of black liquor impregnation is that very even soaking of the chips is obtained at a relatively high temperature so that the white liquor, when it is added, can diffuse very rapidly into each individual chip piece. In our above-described application, an account is given of a process in which we have attempted to exploit the above-mentioned advantages associated with black liquor impregnation.

However, there are certain disadvantages from the point of view of equipment in the process which we previously proposed, inter alia, the existence of central pipes which are arranged at the top and hang downwards.

We have now found that by using a two-vessel system, in which the actual cooking vessel is a steam/liquor-phased system, substantial advantages can be gained when cooking sulphate cellulose pulp from a preceding black liquor impregnation when white liquor is supplied to the fiber material at the top of the digester so that, inter alia, the advantage is gained that the bottom scraper in the impregnation vessel does not have any real influence in diminishing the fiber strength of the fiber material, since substantially no white liquor is present at that juncture.

Additionally, in accordance with a preferred embodiment of the invention, the requirement for central pipes can be eliminated, making an installation much simpler and considerably cheaper.

DETAILED DESCRIPTION

Figure 1:
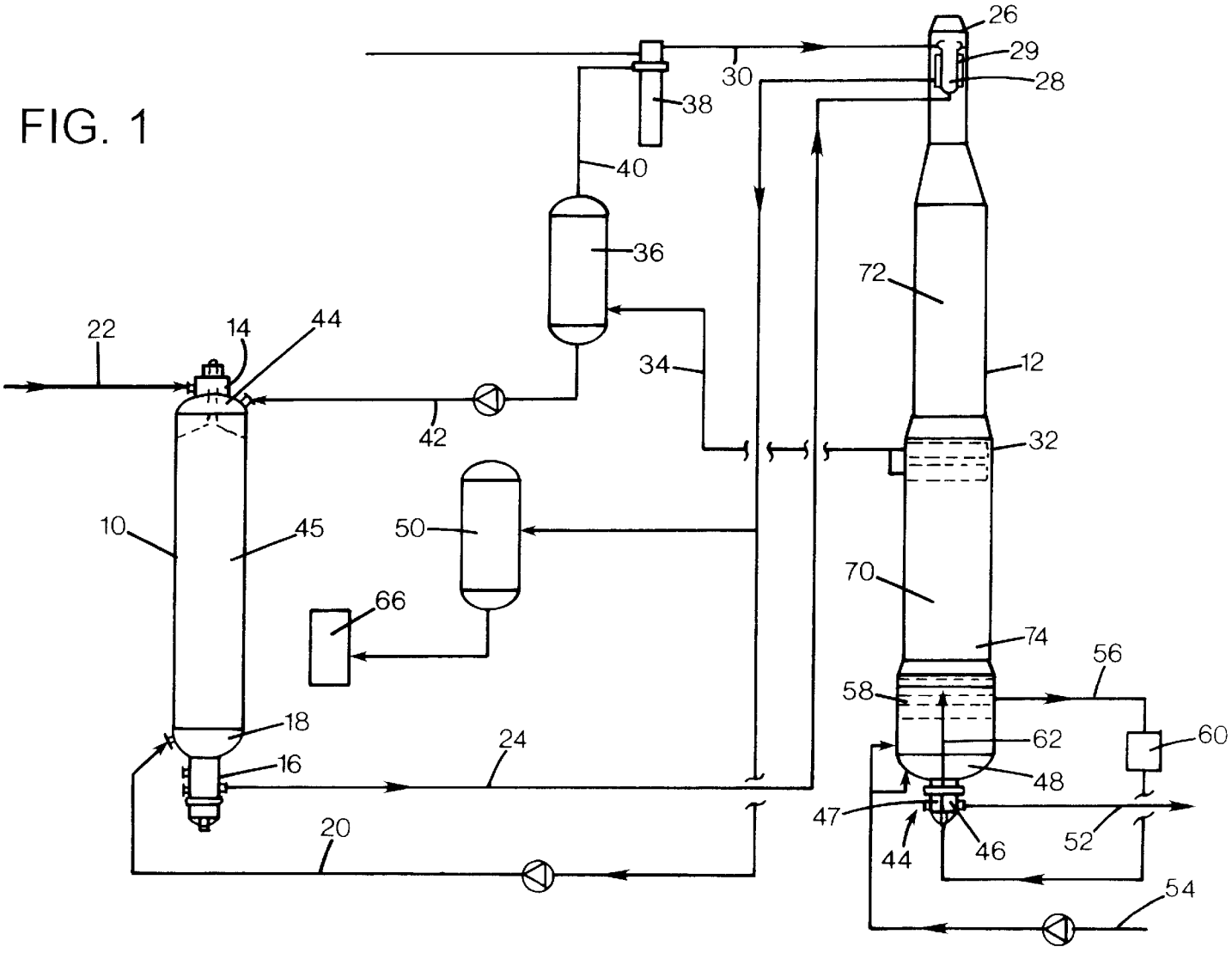
FIG. 1 is a schematic view of a preferred embodiment of a continuous digester system according to the present invention.

FIG. 1 shows a preferred embodiment of a part of a fiber line for producing chemical pulp according to the present invention. The most important main components in the system consist of an impregnation vessel 10 and a steam/liquid-phase digester 12. The impregnation vessel 10 possesses a feeding-in device 14 at the top, which feeding-in device may be of a conventional type, i.e. a top separator with screw-feed device which feeds the chips in a downward direction. At the bottom, the impregnation vessel 10 possesses a feeding-out device 16 comprising a bottom scraper 18. The impregnation vessel has an impregnation zone for thoroughly heating and impregnating wood chips flowing therethrough. In addition to this, there is a conduit 20 for conveying transport liquor from the top of the digester 12 to the bottom of the impregnation vessel 10. A portion of the black liquor of the transport liquor is passed directly or via a flash tank 50 to a recovery system 66 after it has been separated from at the top of the digester. It is to be understood that the liquid that is sent to the recovery system may be taken from any place between the top of the digester (after separation) and the bottom of the impregnation vessel before it is mixed with the chips for transfer to the top of the digester.

The wood chips are fed to the impregnation vessel 10 via a conduit 22 which is connected to a high-pressure feeder (not shown). The feeder may be arranged in a known manner via a chute under a steaming vessel and may be connected to necessary liquid circulations and replenishment.

A conduit 24 for transporting chips leads from the bottom of the impregnation vessel 10 up to a top portion 26 of the digester 12. The conduit 24 may open out at the bottom of a feeding device 28 which feeds by means of a screw in an upwardly moving direction. It should be understood that the present invention is not limited to the top portion herein described but that other types of feeding mechanisms may also be used.

A screen may be used to draw off the liquid together with which the chips are transported up to the top portion 26. Approximately on a level with or at a suitable distance above the upper edge of the screen (over which edge the chips tumble out), there may be arranged an annular ring 29 having a plurality of holes defined therein. The annular ring 29 may be connected to a conduit 30 which leads to a cooking liquor container such as a white-liquor container (not shown). All the above mentioned cooking apparatus is located in the actual steam space in the digester 12. It is to be understood that the feeding device may be of another type not using an annular ring.

A screen girdle section 32 may be arranged in conjunction with a step-out approximately in the middle of the digester 12. Drawn-off spent liquor, such as hot black liquor, from this screen girdle section 32 can be conducted directly via a conduit 34 to a first flash tank or flash cyclone 36 for improved heat economy when steam is removed from the black liquor. It is also possible to transport the black liquor directly to the impregnation vessel 10 without passing the black liquor through a flash tank. At least 60% of the spent liquor withdrawn is supplied to the impregnation vessel 10. In the preferred embodiment of the present invention, at least 70% of the spent liquor withdrawn from the digester 12 is directed to an inlet of the impregnation vessel 10. More preferably, at least 80% of the spent liquor withdrawn from the digester are transferred to the impregnation zone of the impregnation vessel 10. Most preferably, between 90% and 100% of all the spent liquor withdrawn is transferred to the impregnation vessel 10.

Any steam generated by the hot black liquor in the flash cyclone may be in fluid communication with a cooking liquor heater 38 via a conduit 40 for heating up conduit 30 that is adapted to carry the cooking liquor, as explained above.

The black liquor may be directed from the flash cyclone 36 via a conduit 42 to a top portion 44 of the impregnation vessel 10. The spent liquor withdrawn from the digester 12 may have an effective alkali level that at least 13 grams per liter. Preferably, the level at least 16 grams per liter and most preferably the effective alkali level is at least 20 grams per liter.

The digester 12 has a counter-current cooking zone 70 at a lower most portion of the digester. The counter-current zone has a temperature that is higher than the temperature at the beginning of a concurrent cooking zone 72 disposed at the upper end of the steam phased digester 12 so that the temperature difference between the counter-current cooking zone 70 and the concurrent cooking zone 72 is at least 5° C. More preferably, the temperature difference is between about 5° C. and 20° C. Most preferably, the temperature difference is between about 7° C. and 15° C. A certain amount of effective alkaline may be introduced at the bottom portion of the digester 12 in order to obtain a second level of effective alkaline in a lowermost portion 74 of the counter-current cooking zone 70 of the digester 12. The second level of effective alkaline is lower than the effective alkaline level in the concurrent cooking zone of the digester 12. The difference between the effective alkali level in the concurrent cooking zone and the counter-current cooking zone should be at least 20 grams per liter. More preferably, the difference should be more than 25 grams per liter and most preferably the difference should be between 30–50 grams per liter.

At a bottom portion 46 of the digester 12, there is a feeding-out device 47 that may include a scraping element 48. According to a preferred alternative, a "cold-blow" procedure may be carried out so that the temperature of the pulp is being cooled down at the bottom of the digester with the aid of relatively cold (preferably 70°–80° C.) liquid which is added by means of the scraping element 48 and/or other liquid-adding devices 54 (appropriately annular pipes) at the bottom, and then subsequently conducted upwards in a direction that is countercurrent to the flow of the pulp. With the aim of being able to produce ITC™ pulp (high-quality pulp having a low kappa number) a so-called high-heat zone (preferably having essentially the same temperature as in the rest of the cooking zone) may be maintained as far down as possible in the lower part of the digester with the aid of a lower circulation 56, 58, 60, 62, a so-called ITC™ circulation. This lower circulation may consist of a screen girdle section 58 which is arranged at sufficient height above a lower liquid-addition point 48 and/or 54 to permit the attainment of a desired flow from the latter liquid-addition point towards the screen section 58, which height depends on the shape of the digester bottom (spherical bottom or not) and its diameter. Normally, the middle of the screen section should then be about 3–5 meters above the scraping element 48, and in extreme instances be placed more than 2 meters above the scraper 48 but less than 7 meters above the latter. The draw-off from the screen girdle 58 may be recirculated (for displacing black liquor in countercurrent to the draw-off screen 32) into the digester with the aid of a standpipe 62 which opens out approximately on a level with the said screen girdle section 58. For construction reasons, attempts should be made to keep the length of the pipe 62 as short as possible, but, in conformity with that which has been discussed above, the length should not be less than about 2 meters. In order to be able to withstand momentary large lateral forces, the thickness of the material should exceed 10 mm, preferably exceed 14 mm, and/or be stiffened/strengthened with the aid of structures arranged inside the pipe 62. A heat exchanger 60 for temperature regulation (raising the temperature of the re-introduced liquid) and a pump may also be located in the conduit 56 which connects the screen girdle 58 with the pipe 62. The recirculation loop 56 may also be connected via a branch conduit 52 to the white liquor supply so that fresh alkali can be supplied and, in the form of countercurrent cooking, offer the possibility of further reducing the kappa number. The digester construction described is notable for the lack of central pipes arranged from above and hanging downwards, as well as of feed pipes connected to them and of other necessary parts for the circulations. It is to be understood that the present invention does not require the above described ITC system and that other designs and systems may be used.

A preferred installation according to the invention may function as follows. The chips are fed in a conventional manner into a chips silo and conveyed via a steaming vessel (not shown) and a chute (not shown) to the high-pressure feeder which in a known manner may be supplied with a minor amount of white liquor in order to lubricate it. The chips are then fed into conduit 22 together with the transport liquid. The chips and the liquid which have been fed to the top of the impregnation vessel 10 in this way have a temperature of about 110°–115° C. and a liquid/wood ratio of about 5–7/1 on entry to the digester (excluding recirculated transport liquor).

The optimal temperature for the "slurry" depends on the pressure which is being maintained in the steaming vessel. Specifically, the temperature should not exceed the steam-formation value for the pressure prevailing in the chute down to the high-pressure tap since, otherwise, "bangs" can occur in connection with volatilization towards the chute from the steaming vessel. According to a preferred embodiment, a positive pressure of about 1–2 bar is employed, with a suitable temperature at the top of the impregnation vessel 10 consequently being about 110°–115° C.

In addition to the actual fibers in the wood, the latter also conveys its own moisture (the wood moisture), which constitutes about 50% of the original weight, to the impregnation vessel 10. Over and above this, condensate is present from the steaming, i.e. at least a part of the steam (principally low-pressure steam) which was supplied to the steaming vessel is cooled down to such a low level that it condenses and is then recovered as liquid together with the wood and the transport liquid. The transport liquid consists principally of chips moisture, condensate and make-up.

The chips which are fed out from the bottom of the top screen may then move slowly downwards in a plug flow through the impregnation vessel 10 in a liquid/wood ratio of about 5–7/1. Hot black liquor, which is drawn off from the draw-off screen 32 of the digester 12, is added, via conduit 42, high up in the impregnation vessel 10, preferably at an upstream end of the impregnation vessel such as the upper portion 44. In the preferred embodiment, a substantial amount of the spent liquor withdrawn from the digester 12 is transferred to the impregnation vessel 10. The hot black liquor flows concurrently with the chips slurry including chips, condensate, transport liquid and wood moisture, which flow through the impregnation vessel 10 from the top portion 44 to the bottom portion 16 thereof. The spent liquor withdrawn from the digester 12 has an effective alkali level that is at least 13 grams per liter. More preferably, the effective alkali level of the spent liquor is at least 16 grams per liter. Most preferably, the effective alkali level is about 20 grams per liter. Only an insignificant amount of spent liquor is directly recirculated to a cooking zone inside the steam phased digester 12.

The temperature of the black liquor exceeds 100° C. when it is introduced into the impregnation vessel. Preferably, the temperature of the black liquor is between about 120° C. and 160° C. and most preferably the temperature is between about 130° C. and 150° C. A temperature in the range of 130°–150° C. of the black liquor, ensures rapid heating of the chips, in turn permitting efficient displacement of the wood moisture. In addition, the relatively high pH, exceeding pH 10, of the black liquor means that any acidic condensate accompanying the chips is neutralized, thereby counteracting the formation of incrustation, so-called scaling.

An additional advantage of using black liquor in the impregnation vessel is that the high content of sulphide as compared with that of hydroxide in the black liquor has the consequence that the strength properties of the fibers are not affected negatively by the impregnation since the sulphide, in contrast to the hydroxide, does not attack the carbohydrates in the fibers and only attacks certain readily soluble lignin.

Furthermore, this removes the disadvantages which are associated with using white liquor for the major part of the liquid in the impregnation and which are seen in a loss of fiber strength in connection with the mechanical effect which the bottom scraper in the impregnation vessel 10 exercises on the chips during feeding-out and transfer to the top of the digester 12.

The chips, which have been thoroughly impregnated and partially delignified in this way, are fed to the top of the digester 12 and may be conveyed into the upwardly-feeding top screen. It is to be understood that a wide range of feeding mechanisms may be used in the present invention.

The chips may thus be fed upwardly through the screen and finally fall out over the edge of the screen down through the steam space. Here, too, it is preferred to attempt to maintain a liquid/wood ratio of about 5–7/1. During their free fall, the chips pieces may be showered with cooking liquor, such as white liquor (which is known per se through SE-B-330819, which does not, however, relate to black liquor impregnation) which is supplied by means of the perforated annular pipe 30. The quantity of white liquor which is added here may depend on how much white liquor is added else where, but the total amount corresponds to the quantity of white liquor which is required for achieving desired delignification of the wood. Preferably a major part of it is added here, i.e. more than 60%, which also improves the diffusion velocity, since it increases exponentially in relation to the concentration difference (chip-surrounding liquid). More preferably, at least 70% of the white liquor is added at the top of the digester 12. Most preferably, about 90% of the white liquor required for the cooking reaction is added at the top of the digester 12.

The thoroughly impregnated chips now very rapidly assimilate the active cooking chemicals by diffusion and then move down in a concurrent flow through the digester 12 while maintaining an optimal cooking temperature that is below 160° C. More preferably, the temperature is below about 155° C. and most preferably the temperature is between about 140°–150° C. at the beginning or the uppermost portion of the concurrent cooking zone 72 inside the digester 12.

The major part of the delignification takes place in the first, relatively long (in relation to conventional digester) concurrent cooking zone 72. The concurrent cooking zone 72 has an effective alkali level that is at least 35 grams per liter at the beginning of the concurrent cooking zone of the digester 12. More preferably, the effective alkali level is at least 40 grams per liter and most preferably the effective alkaline level is between 45 and 55 grams per liter.

The cooking liquid mingled with released lignin, etc., is drawn off at the draw-off screen 32 as a result of the liquid which was fed in countercurrent using the pipe 62 having displaced it from the wood upwards towards the draw-off screen 32. This results, consequently, in the delignification being prolonged in the digester 12. A prerequisite for obtaining this prolonged cooking is that the temperature in this lower zone is sufficiently high, i.e. preferably exceeding 140° C., preferably about 150°–160° C., in order to dissolve lignin. In the preferred case, the aim is to maintain essentially the same temperature in all the cooking zones (so-called ITC™ cooking, ITC=IsoThermal Cooking), consequent upon which there are many advantages such as good pulp quality, low chemical consumption, low energy consumption, etc. Expediently, the lower circulation 56, 58, 60, 62 is charged with about 5–20%, preferably about 10%, white liquor. The temperature of the liquid which is recirculated via the pipe 62 is regulated with the aid of a heat exchanger 60 so that it corresponds approximately to the cooking temperature.

In the preferred case, "cold-blow" is used, with the temperature of the pulp in the outlet conduit 52 being less than 100° C. Accordingly, washing liquid having a low temperature, preferably about 70°–80° C., is added in a known manner using the scraping element and an outer annular conduit 54 arranged at the bottom of the digester 12. This liquid consequently displaces the boiling hot liquor in the pulp upwards in countercurrent and thereby imparts a temperature to the remaining pulp which can be cold-blown, i.e. depressurized and disintegrated without any real loss of strength.

From some test made in labscale, however, we have found indications that under some circumstances it would be desired to keep the alkaline level at above at least 2 grams per liter, preferably at least 4 grams per liter, in the impregnation vessel in connection with black liquor, which would normally correspond to a pH of about 11. If not it appears that dissolved lignin precipitate in a manner so as to form some kind of "protective" layer around the chips. According to a preferred embodiment ITC™ (PCT/SE93/00816 and PCT/9300978) is used which means that about 10% of the white liquor is added in the lower countercurrent zone 72 of the digester 12. By using ITC it also easier to adjust the rest alkaline level of the drawn off black liquor 32 to a relatively high level which then could be adapted to the above requirements.

The invention is not limited to that which has been shown above but can be varied within the scope of the subsequent patent claims. Thus, there are a multiplicity of alternatives to the perforated annular pipe which has been shown for uniformly drenching the chips with white liquor. For example, a centrally arranged inlet having a spreading device can be contrived that provides a mushroom-like film of liquid, as can a centrally arranged showering element or an annular pipe with slots, etc. In addition, the number of screen girdles shown can be varied in dependence on different requirements. Also, the invention is in no way limited to a certain screen configuration and it should be understood that bar screens, for example, such as screens having slots cut out of sheet metal, can be used. Also in some installations moveable screens are preferred.

Furthermore, in order to amplify the ITC™ effect, measures can be taken which decrease heat losses from the digester, such as, for example, insulation of the digester shell and/or maximization of the volume in relation to the outwardly exposed surface, i.e. increasing the cross-sectional area. In order to improve the distribution of the white liquor added at the top of the digester 12, it is possible to instal a so called "quench circulation" which would recirculate a desired amount of liquid from below the top screen 26 back to the annular pipe 30. For this purpose ordinary screens is not a requirement. Finally if severe foaming problems would occur, this might be eliminated by supplying all or some of the hot black liquor to the impregnation vessel after the black liquor has passed through the first flashing device (whereby the black liquor is degassed).

While the present invention has been described in accordance with preferred compositions and embodiments, it is to be understood that certain substitutions and alterations may be made thereto without departing from the spirit and scope of the following claims.

We claim:

1. A method for continuously producing pulp, comprising the steps of:

providing a finely divided fiber material and an impregnation vessel, the impregnation vessel maintaining a cooking pressure;

providing a digester having a top and a bottom and at least one screen disposed therein, the digester being adapted to facilitate a cooking reaction, the screen being adapted to withdrawing spent liquor, the digester having a concurrent cooking zone, the concurrent cooking zone having a beginning and an end;

providing a hot black liquor and a cooking liquor, an amount of the cooking liquor being required for the cooking reaction wherein the cooking liquor is white liquor;

transferring the hot black liquor to the impregnation vessel;

while transferring the hot black liquor, heating and thoroughly impregnating the fiber material disposed in the impregnation vessel by exposing the fiber material to the black liquor injected in a direction that is concurrent with a flow of the fiber material wherein the liquor injected for impregnating the fiber material consists of the hot black liquor;

while heating and impregnating the fiber material, transferring the heated and thoroughly impregnated fiber material from the impregnation vessel to the top of the digester;

while transferring the heated and thoroughly impregnated fiber material, supplying at least 60% of the amount of cooking liquor required for the cooking reaction to the top of the digester;

while supplying the cooking liquor, digesting the fiber material in the concurrent cooking zone of the digester;

while digesting the fiber material, withdrawing spent liquor, that have passed at least one cooking zone of the digester, at the screen of the digester so that the spent liquor has an amount of effective alkali that is at least 13 grams per liter and only an insignificant portion of the spent liquor withdrawn is directly recirculated to a cooking zone in the digester;

while withdrawing spent liquor, feeding out pulp at the bottom of the digester;

while feeding out pulp, maintaining a first temperature that is below 160 degrees Celsius at the beginning of the concurrent cooking zone of the digester;

while maintaining the first temperature, supplying a sufficient amount of cooking liquor to the top of the digester; and while supplying the cooking liquor, obtaining a first level of effective alkali that is at least 35 grams per liter at the beginning of the concurrent cooking zone of the digester.

2. The method according to claim 1 wherein step of providing a finely divided fiber material includes the step of providing wood chips.

3. The method according to claim 1 wherein more than 70% of the amount of cooking liquor required for the chemical reaction is supplied to the top of the digester.

4. The method according to claim 1 wherein the first temperature is below 155 degrees Celsius.

5. The method according to claim 1 wherein the first temperature is between 140 degrees Celsius and 150 degrees Celsius.

6. The method according to claim 1 wherein the step of withdrawing spent liquor includes the step of withdrawing spent liquor having an effective alkaline level that is at least 16 grams per liter.

7. The method according to claim 1 wherein the step of withdrawing spent liquor includes the step of withdrawing spent liquor having an effective alkali level that is at least 18 grams per liter.

8. The method according to claim 1 wherein the step of withdrawing spent liquor includes the step of withdrawing spent liquor having an effective alkali level that is about 20 grams per liter.

9. The method according to claim 1 wherein the step of obtaining the effective alkali first level includes the step of obtaining an effective alkali first level that exceeds 40 grams per liter.

10. The method according to claim 9 wherein the step of obtaining the effective alkali level includes the step of obtaining an effective alkali level that is between 45 grams per liter and 55 grams per liter.

11. The method according to claim 1 wherein the step of withdrawing spent liquor includes the step of supplying at least 60% of the spent liquor to the impregnation zone.

12. The method according to claim 11 wherein the step of supplying spent liquor includes the step of supplying the spent liquor to an upstream end of the concurrent zone of the impregnation vessel.

13. The method according to claim 11 wherein the step of withdrawing spent liquor includes the step of supplying the spent liquor to the impregnation vessel when the spent liquor has a temperature exceeding 100 degrees Celsius.

14. The method according to claim 13 wherein the step of withdrawing spent liquor includes the step of supplying the spent liquor to the impregnation vessel when the spent liquor has a temperature of between 120 degrees Celsius and 160 degrees Celsius.

15. The method according to claim 13 wherein the step of withdrawing spent liquor includes the step of supplying the spent liquor to the impregnation vessel when the spent liquor has a temperature of between 130 degrees Celsius and 150 degrees Celsius.

16. The method according to claim 11 wherein the step of supplying spent liquor includes the step of passing the spent liquor through a first flash tank and then supplying the spent liquor to the impregnation vessel.

17. The method according to claim 1 wherein the method comprises providing a steam phased digester having a counter-current cooking zone including a lowermost portion having a second temperature so that the second temperature is higher than the first temperature of the concurrent cooking zone of the digester.

18. The method according to claim 17 wherein the second temperature is at least 5 degrees Celsius higher than the first temperature.

19. The method according to claim 17 wherein the second temperature is between 5 degrees Celsius and 20 degrees Celsius higher than the first temperature.

20. The method according to claim 19 wherein the second temperature is between 7 degrees Celsius and 15 degrees Celsius higher than the first temperature.

21. The method according to claim 17 wherein the method further includes the step of supplying a certain amount of effective alkali to the digester adjacent the bottom thereof and obtaining a second level of effective alkali in the lowermost portion of the counter-current zone of the digester, the second level of effective alkali is lower than the first level of effective alkali so that a difference between the second level and the first level of effective alkali is at least 20 grams per liter.

22. The method according to claim 21 wherein the difference is at least 25 grams per liter.

23. The method according to claim 21 wherein the difference is between 30 and 50 grams per liter.

24. The method according to claim 1 wherein the method further comprises the step of supplying at least 70% of the spent liquor withdrawn to an upper inlet portion of the impregnation vessel.

25. The method according to claim 24 wherein the step of supplying includes the step of supplying at least 80% of the spent liquor withdrawn to the impregnation vessel.

26. The method according to claim 24 wherein the step of supplying includes the step of supplying between 90% and 100% of the spent liquor withdrawn to the impregnation vessel.

27. The method according to claim 24 wherein the step of providing black liquor includes the step of conveying black liquor directly to a recovery system after the black liquor has been separated from the fiber material and a liquid stream removed from the impregnation vessel.

* * * * *